United States Patent [19]

Guerra

[11] 4,184,727

[45] Jan. 22, 1980

[54] DOCUMENT SORTER

[76] Inventor: Felix S. Guerra, 723 Alice Dr., Lafayette, La. 70503

[21] Appl. No.: 901,707

[22] Filed: May 1, 1978

[51] Int. Cl.[2] ..... A47B 88/20; B42F 17/18

[52] U.S. Cl. ..... 312/350; 211/10

[58] Field of Search ..... 312/270, 350; 108/93; 271/64, 173; 206/557, 558; 220/22; 211/10, 11

[56] References Cited

U.S. PATENT DOCUMENTS

| | | | |
|---|---|---|---|
| 252,394 | 1/1882 | Moon | 211/10 |
| 1,083,776 | 1/1914 | Thompson | 211/10 |
| 1,135,038 | 4/1915 | Middaugh | 211/10 |
| 1,603,776 | 10/1926 | Joly | 211/11 |
| 2,382,429 | 8/1945 | Loeb et al. | 206/558 |

*Primary Examiner*—Mervin Stein
*Assistant Examiner*—Alexander Grosz
*Attorney, Agent, or Firm*—Russell D. Weaver; Ned L. Conley

[57] ABSTRACT

A device for facilitating the sorting of documents is disclosed. The device includes a housing and a drawer selectively positionable both within the housing and extending from the housing. The housing includes a document accepting portion above and supported by a frame. Both the drawer and the document accepting portion include a series of slots for receiving and temporarily retaining the documents as they are being sorted.

12 Claims, 7 Drawing Figures

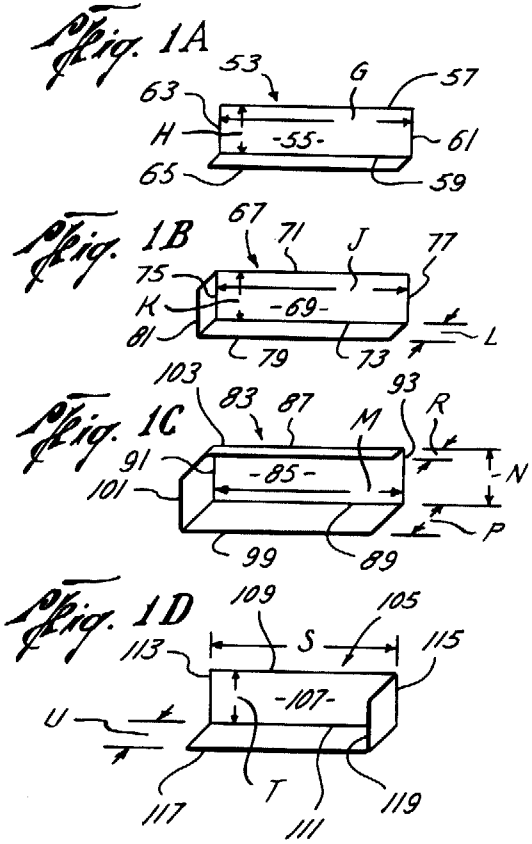
Fig. 1A
Fig. 1B
Fig. 1C
Fig. 1D
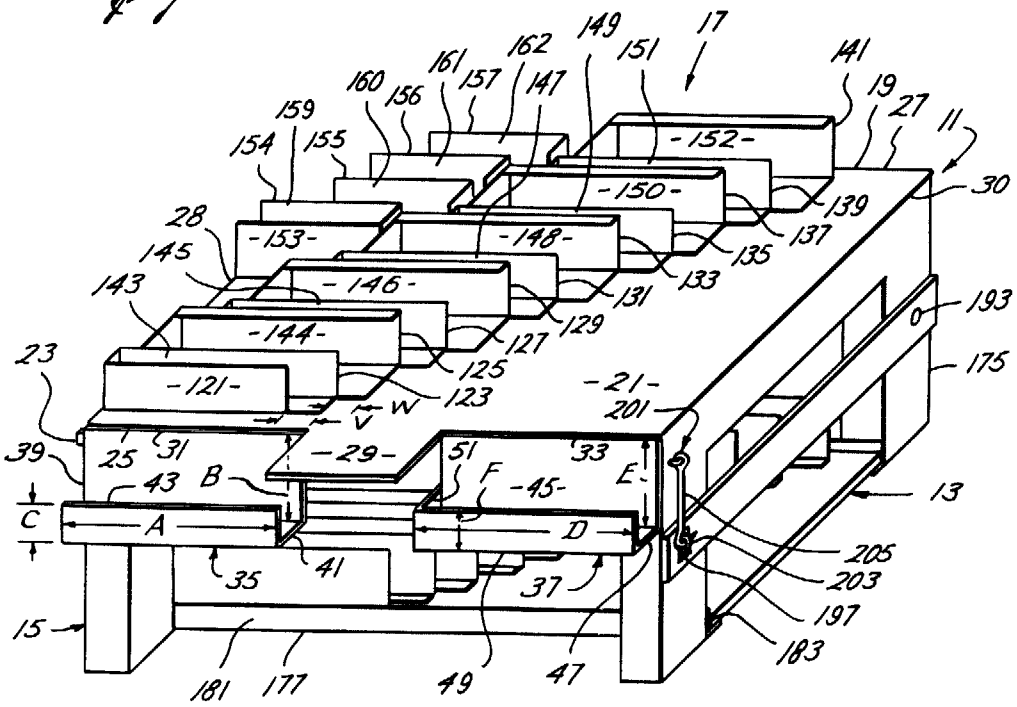
Fig. 1

DOCUMENT SORTER

BACKGROUND OF THE INVENTION

1. Field of the Invention

The present invention relates generally to document organizing systems and more particularly to a device for facilitating the sorting of documents by providing a large number of conveniently arranged document retaining slots in a small area.

2. Description of the Prior Art

The organization of documents is a task that must be performed not only by large businesses but also by individuals arranging family and personal records, such as cancelled personal checks.

Such organization usually entails sorting documents by number, date or subject matter such as author, customer, or the like. Furthermore, normal organization involves putting the documents in numerical, chronological or alphabetical order, as the case may be.

Two basic techniques have been used for such sorting of documents: automatic and manual. According to automatic techniques, the documents are encoded according to their number, date or subject matter as the case may be. Such encoding is accomplished by punching holes in the documents or by placing a photoresponsive or electrically responsive material on the documents. The documents are then sorted automatically by a computerized machine capable of reading the code. These machines are extremely expensive and, therefore, are economical only for large businesses for which document sorting is a major concern.

According to the manual technique, the documents are reviewed and placed in piles of documents having a partiular range of numbers, dates or subject matters. These piles are then separately sorted and re-sorted. Where a large number of documents are involved, several piles must be made consuming substantial workspace. The physical arrangement of the piles often is haphazard. As a result, much time is wasted looking for the pile in which each document belongs. More time is wasted when the piles must be shifted to make room for a new pile.

Vertical files, including a plurality of elongate, parallel slots open on the top and on both ends, have sometimes been used for facilitating this second technique of document organization by retaining documents in vertically-oriented piles. Generally, the slots of such files are relatively deep thus making them unavailable for smaller documents such as checks. Furthermore, the slots are aligned with one another thus making it difficult to see the documents in the rear slots when the front slots are retaining documents. Proper placement of the documents in the slots is further complicated by the fact that such placement requires lifting the documents directly above th slots and dropping them vertically into the slots. Thus, documents must be lifted over the documents in the front slots and carefully positioned over the appropriate slot. Also, if subdivisions and subsubdivisions of the piles must be made, the originally divided piles must be removed from the file and placed to one side in horizontally oriented stacks while further division of each pile is made.

SUMMARY OF THE INVENTION

The object of the present invention is to facilitate the above-described second technique of document sorting by providing a device whereby documents can be sorted into piles in a relatively compact area. The device further provides for temporary storage of unsorted and partially sorted piles while the piles are further sorted. This enables individual review of the documents as they are being sorted in the order that they were received.

The device includes a housing and a drawer. The housing has a frame supporting a document sorting portion. The drawer is slidingly disposed within such housing generally beneath the document accepting portion.

Both the document accepting portion and the drawer include series of slots for retaining documents in a generally vertical orientation. These slots may be staggered so as to permit ready access to the rear slots when the front slots contain documents. Furthermore, one end of the slots may be closed so that the documents may be placed in the slots by moving them in both a vertical and horizontal direction, the closed end preventing the document from moving horizontally out of the slot.

BRIEF DESCRIPTION OF THE DRAWINGS

For a further understanding of the nature and objects of the present invention, reference should be had to the following detailed description, taken in conjunction with the accompanying drawings in which like parts are given like reference numerals and wherein:

FIG. 1 is a pictorial diagram of the device of the preferred embodiment of the invention with the drawer in the storage position;

FIGS. 1A-1D are pictorial diagrams of standard configurations types A,B,C and D, respectively, used in the device of the preferred embodiment of the invention;

DETAILED DESCRIPTION OF THE PREFERRED EMBODIMENT

Figures 2, 3:
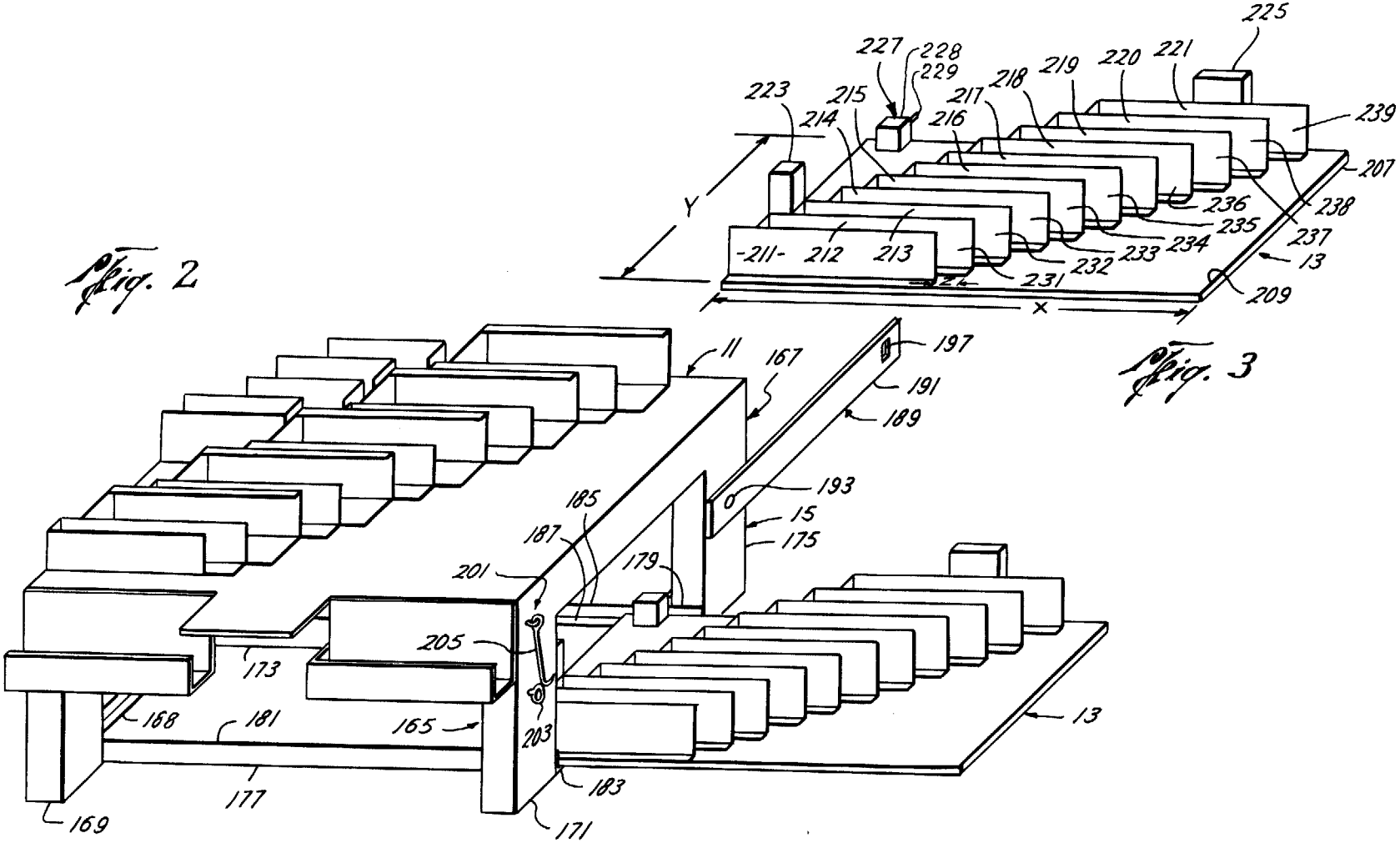
FIG. 2 is a pictorial diagram of the device of the preferred embodiment of the invention with the drawer in the operation position.
FIG. 3 is a pictorial diagram of the drawer used in the device of the preferred embodiment of the invention.

Referring to FIGS. 1-3, the apparatus of the preferred embodiment of the invention includes housing 11 and drawer 13.

Housing 11 includes frame 15 and document accepting portion 17. Document accepting portion 17 includes flat upper platform 19 having upper surface 21, lower surface 23, front edge 25, rear edge 27, and side edges 28, 30. Platform 19 also has tab 29 extending from front edge 25 and dividing front edge 25 into portions 31, 33. Tab 29 is coplanar with the remainder of platform 19.

Document accepting portion 17 also includes front document receptacles 35, 37. Receptacle 35 includes flat rectangular portions 39, 41, 43 each having width A. Portions 39, 43 of receptable 35 extend upwardly from opposite sides of portion 41. Portions 39, 43 are both perpendicular to portion 41. Portions 39, 43 extend a distance B, C, respectively, above portion 41, distance B being greater than distance C. Portion 39 is connected along its uppermost side to front edge portion 31 of platform 19 such that portion 39 extends generally below platform 19 in a plane perpendicular to that of platform 19.

Receptacle 37 includes flat rectangular portions 45, 47, 49 each having width D. Portions 45, 49 extend upwardly from opposite sides of portion 47. Portions 45, 49 are both perpendicular to portion 47. Portions 45, 49 extend a distance E, F, respectively, above portion 47, distance E being greater than distance F. Portion 45 is connected along its uppermost side to front edge portion 33 of platform 19 such that portion 45 extends generally below platform 19 in a plane perpendicular to that of platform 19. Receptacle 37 further includes document stop 51 extending between portions 45 and 49 along a part of the edges of portions 45, 49 facing generally toward tab 29.

Receptacles 35, 37 may be substantially identical to one another with dimensions A, B, C being equal to dimensions D, E, F, respectively. Receptacles 35, 37 may be formed from a flat strip of bendable material, such as sheet metal, by bending the strip around two parallel axes, such axes defining the sides of portions 41 and 47 from which the remaining portions of the receptacle extend. Stop 51 of receptacle 37 may be a separate piece of material secured between portions 45 and 49.

Document accepting portion 17 further includes a plurality of standards secured to upper surface 21 of platform 19. The standards may be of varying configurations such as those shown in FIGS. 1A through 1D.

Referring to FIG. 1A, standard 53, referred to hereinafter as an A-type standard, includes flat rectangular plate 55 having upper side 57, lower side 59, first end 61 and second end 63. Plate 55 has length G and height H. The A-type standard further includes base flange 65 extending from lower side 59 of plate 55 along the entire length of side 59. Flange 65 is perpendicular to plate 55.

Referring to FIG. 1B, standard 67, referred to hereinafter as a B-type standard, includes flat rectangular plate 69 having upper side 71, lower side 73, first end 75 and second end 77. Plate 69 has length J and height K. The B-type standard further includes base flange 79 extending a distance L from lower side 73 of plate 69 along the entire length of side 73. Flange 79 is perpendicular to plate 69. The B-type standard also includes side flange 81 extending distance L from end 75 of plate 69 along the entire length of end 75. Flange 81 is perpendicular to both plate 69 and base flange 79.

Referring to FIG. 1C, standard 83, referred to hereinafter as a C-type standard, includes flat rectangular plate 85 having upper side 87, lower side 89, first end 91 and second end 93. Plate 85 has length M and height N. C-type standard further includes base flange 99, side flange 101 and top flange 103. Base flange 99 extends a distance P perpendicularly from plate 85 along the entire length of lower side 89. Side flange 101 extends distance P perpendicularly from plate 85 along the entire length of end 91. Top flange 103 extends a distance R perpendicularly from plate 85 along the entire lengh of upper side 97. Distance R is less than distance P.

Referring to FIG. 1D, standard 105, referred to hereinafter as a D-type standard, includes flat rectangular plate 107 having upper side 109, lower side 111, first end 113 and second end 115. Plate 107 has length S and height T. D-type standard further includes base flange 117 and side flange 119. Base flange 117 extends perpendicularly a distance U from plate 107 along the entire length of lower edge 111. Side flange 119 extends perpendicularly a distance U from plate 107 along the entire length of end 115.

The standards shown in FIGS. 1A through 1D each may be made from a flat piece of bendable material, such as sheet metal, by bending such piece about appropriate axes to form the plates and flanges of such standard.

Referring again to FIG. 1, A-type standard 121 is secured to upper surface 21. The base flange of standard 121 rests on surface 21 and extends away from front edge 25. The lower side of the plate of standard 121 is spaced slightly behind front edge portion 31 and extends parallel to front edge portion 31. The intersection of the first end and the lower side of the plate of standard 121 is located proximate side edge 28 of platform 19.

B-type standard 123 is secured to upper surface 21 behind A-type standard 121. The base flange of standard 123 rests on the base flange of standard 121 such that the plate of standard 123 is parallel to the plate of standard 121. The side flange of standard 123 is aligned with edge 61 of standard 121. Preferably, length J of standard 123 is greater than length G of standard 121 so that the second end of the plate of standard 123 is staggered a distance V beyond the second end of the plate of standard 121.

C-type standard 125 is secured to upper surface 21 behind B-type standard 123. The base flange of standard 125 faces toward standard 123 such that a portion of the forward edge of such base flange abuts the lower side of the plate of standard 123 and such that the plate of standard 125 is parallel to the plate of standard 123. The side flange of standard 125 is staggered from the first end of the plate of standard 123 a distance W. Preferably, distance W is equal to distance V. Also, preferably, length M of standard 125 is equal to length J of standard 123 so that the second end of the plate of standard 125 extends the distance W beyond the second end 77 of the plate of standard 123.

B-type standard 127 is secured to upper surface 21 behind C-type standard 125. The base flange of standard 127 faces toward standard 125 such that a portion of the forward edge of such base flange abuts the lower side of the plate of standard 125 and such that the plate of standard 127 is parallel to the plate of standard 125. The side flange of standard 127 is staggered from the first end of the plate of standard 125 the distance W. Preferably, length J of standard 127 is equal to length M of standard 125 so that the second end of the plate of standard 127 extends the distance W beyond the second end of the plate of standard 125.

C-type standards 129, 133, 137, 141 and B-type standards 131, 135, 139, all having lengths equal to length J of standard 123, are secured to upper surface 21 behind B-type standard 127 such that C-type standards 129, 133, 137, 141 alternate with B-type standards 131, 135, 139. C-type standard 129 is positioned relative to standard 127 in the same manner that standard 125 is positioned relative to standard 123. B-type standards 131, 135, 139 are positioned relative to C-type standards 129, 133, 137, respectively, in the same manner that standard 127 is positioned relative to standard 125. C-type standards 133, 137, 141 are positioned relative to B-type standards 131, 135, 139, respectively, in the same manner that standard 125 is positioned with respect to standard 123.

The above described arrangement of standards 121 through 141, results in the formation of staggered slots 143 through 152. Each such slot has a forward wall defined by the standard to the front of the slot, a rear wall defined by the standard to the rear of the slot, and a left-end wall defined by the end flange of the standard to the rear of the slot. The top and the right end of each such slot are open. Furthermore, the rear wall of each such slot extends beyond the right end of the forward wall of such slot.

Preferably, distances L of B-type standards 123, 127, 131, 135, 139 are all equal to one another and less than distances P of C-type standards 125, 129, 133, 137, 141, all such distances P being equal to one another. As a result, slots 144, 146, 148, 150, 152 are of equal width and are wider than slots 143, 145, 147, 149, 151, such latter slots being of equal width.

Furthermore, in the preferred embodiment, heights K of B-type standards 123, 127, 131, 135, 139 are all equal to one another and are less than heights N of C-type standards 125, 129, 133, 137, 141, all such heights N being equal to one another. Height H of A-type standard 121 is equal to heights K of B-type standards 123, 127, 131, 135, 139. As a result, the rear walls of slots 144, 146, 148, 150, 152 extend above the rear walls of the other slots.

Document accepting portion 17 also includes D-type standards 153–156 and A-type standard 157 all attached to surface 21. Preferably, heights T of standards 153–156 and height H of standard 157 are equal to one another. Also, preferably, distances U of standards 153–156 are equal to one another.

Standard 157 extends between side edge 28 and the end flange of standard 133. Standard 157 is perpendicular to edge 28 and the base flange of standard 157 extends toward the front of platform 19.

Standard 153 is positioned directly behind standard 157 and, like standard 157, extends between side 28 of platform 19 and the side flange of standard 133. The base flange of standard 153 faces toward standard 157 such that the forward edge of such flange abuts the lower side of the plate of standard 157. The side flange of standard 153 juxtaposes the side flange of standard 133.

Standard 154 is positioned directly behind standard 153 with a portion of the forward edge of the base flange of standard 154 abutting the lower side of the plate of standard 153. Standard 154 is staggered to the right of standard 153 such that the side flange of standard 154 juxtaposes the side flange of standard 135.

Standard 155 is positioned with respect to standard 154 in the same manner as standard 154 is positioned with respect to standard 153. The side flange of standard 155 juxtaposes the side flange of standard 137. Standard 156 is positioned with respect to standard 155 in the same manner as standard 154 is positioned with respect to standard 153. The side flange of standard 156 juxtaposes the side flange 81 of standard 139.

The above-described arrangement of standards 153–157 results in the formation of staggered slots 159–162. Each such slot has a forward wall defined by the standard to the front of the slot, a rear wall defined by the standard to the rear of the slot, and a right-end wall, defined by the side flange of the standard to the rear of the slot. The top and the left-end of each such slot are open.

Frame 15 of housing 11 includes front support 165 and rear support 167 made of any rigid material. Front support 165 includes front legs 169, 171 extending downwardly from the forward corners of platform 19 and brace 173 disposed directly beneath platform 19 and extending between legs 169 and 171. Rear support 167 includes rear leg 175 and another rear leg (not shown) extending downwardly from the rearward corners of platform 19. Rear support 167 further includes a brace (not shown) disposed directly beneath platform 19 and extending between the rear legs.

Frame 15 further includes drawer guides 177, 179 extending between the front legs and the rear legs, respectively. Guide 177 includes vertical portion 181 secured near the bottom of the rear of the front legs and horizontal portion 183 extending from the bottom of vertical portion 181 in a rearward direction. Guide 179 is a mirror-image of guide 177; i.e., guide 179 is disposed parallel to guide 177 and on an even level with guide 177. Guide 179 includes vertical portion 185 secured near the bottom of the front of the rear legs and horizontal portion 187 extending from the bottom of vertical portion 185 in a forward direction. Guides 177, 179 may be right-angle irons made of a rigid material such as aluminum.

Frame 15 also includes drawer stop 188 (see FIG. 2) and drawer latch 189. Drawer stop 187 extends between the outside front leg 169 and the outside rear leg directly behind front leg 169. Stop 188 is positioned above the level of guides 177, 179. Drawer latch 189 includes bar 191 having hole 197 at one end 195 and secured at other end 199 to rear leg 175 by pivot pin 193 such that bar 191 may be pivoted about pin 193 and such that end 195 can move a short distance in a direction parallel to the pivot axis. Latch 189 further includes latch mechanism 201 which may include eye bolt 203 and hook 205. In the latched position, bar 191 extends from rear leg 175 to front leg 171 such that eye bolt 203 extends through hole 197 and hook 205 is latched through the eye of eye bolt 203.

Referring to FIG. 3, drawer 13 includes drawer base 207 having upper surface 209 of length X and width Y. Length X is slightly less than the length of platform 19 along front edge 25. Width Y is slightly less than the distance between the vertical portions of drawer guides 177, 179 but greater than the shorter distance between such drawer guides.

Drawer 13 further includes A-type standard 211 and B-type standards 212–221, all secured to the upper surface 209. Lengths J of standards 212–221 are equal to one another and greater than length G of standard 211 by an amount Z. Height H of standard 211 and heights K of standards 212–221 are equal to one another and are less than the distance from lower surface 23 of platform 19 to the upper surfaces of the horizontal portions of guides 177, 179.

Standard 211 is disposed just behind the front edge of drawer base 207 with the base flange of standard 211 facing forward. Standard 211 extends from the left side edge of base 207 in a direction parallel to the front edge of base 207.

Standard 212 is disposed behind standard 211 with the base flange of standard 212 extending toward standard 211. A portion of the forward edge of the base flange of standard 22 abuts the lower side of the plate of standard 211. The side flange of standard 212 is aligned with the side of standard 211 adjacent the side edge of base 207. As a result, standard 212 extends a distance Z to the right of standard 211.

Standard 213 is disposed behind standard 212 with the base flange of standard 213 extending toward standard 212. A portion of the forward edge of the base flange of standard 213 abuts the lower side of the plate of standard 212. Standard 213 is staggered to the right of standard 212 distance Z.

Standards 214–221 are positioned successively behind standard 213, each succeeding standard being positioned relative to the standard in front of it in the same manner as standard 213 is positioned relative to standard 212.

The above-described arrangement of standards 211-212 results in the formation o staggered slots 231-239. Each such slot has a forward wall defined by the standard to the front of the slot, a rear wall defined by the standard to the rear of the slot, and a left-end wall defined by the end flange of the standard to the rear of the slot. The top and the right end of each slot are open. Furthermore, the rear wall of each such slot extends beyond the right end of the forward wall of such slot.

Drawer 13 also includes stabilizers 223, 225 and pull stop 227. Stabilizers 223, 225 are secured proximate opposite corners of base 213 and extend vertically upward a distance slightly less than the distance from lower surface 23 of platform 19 to the upper surfaces of the horizontal portions of guides 177, 179. Pull stop 227 is secured to base 207 near the left rear corner of base 207, but set off from the left side of base 207 a distance slightly greater than the width of the rear legs. Pull stop 227 includes post 228 extending vertically from base 207 a distance less than the heights of stabilizers 223, 225. Stop 227 includes stop pin 229 extending horizontally rearwardly from post 228 and beyond the rear edge of base 207.

Drawer 13 has two basic positional relationships with housing 11: storage as shown in FIG. 1, and operation as shown in FIG. 2. In the storage position, drawer 13 is generally enclosed by housing 11. Base 207 is supported by drawer guides 177, 179 and is in sliding engagement therewith. Drawer stop 187 prevents movement of drawer 13 beyond the left side of housing 11. Bar 191 is in the latched position and prevents movement of drawer 13 beyond the right side of housing 11. Stabilizers 223, 225 extend between base 207 and lower surface 23 of platform 19 and prevent substantial movement of drawer 13 upwardly from guides 177, 179 toward platform 19.

Thus, with the drawer in the storage position, the sorter may be made fairly compact and may be moved from one location to another without drawer 13 falling from housing 11 and without damage to drawer 13.

In the operation position, drawer 13 extends from the right side of housing 11 with only the left end of base 207 supported by guides 177, 179. (See FIG. 2). Further rightward movement of drawer 13 is prevented by the engagement of stop pin 229 with the left side of leg 175. In such a position, stabilizer 223 should still be disposed beneath platform 19 so as to retain drawer 13 in a substantially horizontal position. The extension of drawer 13 from housing 11 should result in exposure to at least the right-most portion of standard 211.

The preferred embodiment of the document sorter is especially well-adapted for placing a large quantity of numbered documents, such as checks, into numerical order. For this reason, the use of the preferred embodiment will be described with regard to ordering numbered checks although the sorter is also well-adapted for alphabetically sorting documents, for sorting documents according to subject matter, and other similar sorting.

The first step in the use of the sorter is to place the sorter on a flat horizontal surface so that the legs are evenly supported. The latch mechanism is then released so that the latch bar can be pulled away from leg 171. When the latch bar is clear of the latch mechanism, the latch bar is pivoted upwardly and to the rear to the position shown in FIG. 2. Drawer 13 is then pulled to the right along guides 177, 179 until drawer 13 is in the operation position.

A stack of checks is then placed in front document receptacle 37 with the numbers of the checks facing forward in the order that they are in when received from the bank. Normally, this order will correspond with the order that debits are listed on the bank's statement. Prior to sorting and while the checks are in receptacle 37 the checks are examined individually in order to see if any errors were made on the bank's statement. When this is completed, the checks are ready for sorting. Assuming the checks extend over a range of several hundreds, not exceeding five sequential hundreds, the checks are first sorted by hundreds. Slot 144 is used for the lowest hundreds, and slot 152 is used for the highest hundreds, with slots 146, 148 and 150 used for the intermediate hundreds. The wider slots are used due to the space consumed by several hundred checks. Thus, the unsorted checks are removed from receptacle 37 as a single check at a time and placed in the slot corresponding to the hundreds number of that particular check. Because the unsorted stack of checks is positioned in the front of the sorter, review of the individual checks is possible during sorting.

When the hundreds sorting is completed, the lowest hundreds stack is removed from slot 144 and placed in now empty front receptacle 37. The next highest hundreds stack is removed front slot 147 and placed in slot 159. The remaining hundreds stack are placed successively in the slots directly behind slot 159 (slots 160, 161, 162, respectively).

The checks are now sorted by tens, with slot 143 used for the zero tens, slot 152 used for the 90's, and slots 144-151 used for the intermediate tens. This sorting is first accomplished for the lowest hundreds which are in front receptacle 37.

Before sorting the remaining hundreds by tens, the lowest hundreds are sorted by units. This sorting is done using the slots of drawer 13 with slot 231 for the zero units, slot 232 for the one units, slot 233 for the two units, and so forth, to slot 239 used for the nine units. At this time, the user can make notations about outstanding or missing checks.

When this is completed, the checks are removed from slots 231-239 sequentially. This stack of fully ordered checks is then returned to slot 143. Then, the next set of tens is sorted according to units in slots 231-239 in the same fashion as the zero tens were sorted, and notations about outstanding or missing checks are made. These checks are then sequentially removed and returned to slot 144. This procedure is followed successively with all the remaining tens stacks in slots 145-151. When completed, there will be a fully ordered group of ten checks in each of slots 143-151. These groups can then be removed sequentially resulting in a fully ordered stack of one hundred checks. Depending on the convenience of the user, this stack may be secured by a rubber band or the like and set aside, or placed in receptacle 35.

The next hundreds stack of checks is then placed in receptacle 37 and sorted first by tens and then by units in the same fashion as just described.

This procedure is followed until all the hundreds stack are fully ordered. When such ordering is completed, the checks may be reviewed or may be removed for indefinite storage.

If the document sorter is to be used primarily for check sorting as described above, the physical dimensions of the slots may be set at optimum values. The following dimensions have been found acceptable for commercial size checks:

Slots 143–152 (First Series)
length of rear wall: 8¾ inches
width of narrow slots: ½ inch
width of wide slots: 2 inches
depth of slots: 2 inches
staggered: 1 inch Slots 231–239 (Second Series)
length of rear wall: 8¾ inches
width: ¼ inch
depth (shortest): 2 inches
staggered: 1 inch Slots 153–156 (Third Series)
length of rear wall: 5½ inches
width: 1½ inches
depth: 2½ inches The document sorter may also be used for sorting documents chronologically by date or alphabetically by subject matter, or author or the like. The particular ranges of each of the particular slots, for example, the range of dates to be put in slot 143, may be determined according to the user's need. After such ranges and slots are determined, the sorting can be further facilitated by labelling the slots with the range of documents to be placed therein. One preferred method of labelling the slots is to place plastic tabs on the top of the rear wall of each slot, the tabs having slots for removably inserting the labels. In this way, the labels can be changed according to the particular needs at a particular time.

Although the system as described in detail supra has been found to be most satisfactory and preferred, different applications and many variations in its elements and the structure of its elements are possible. For example, the housing, including the document accepting portion can be a single integrated piece of molded plastic or similar material. The frame may include solid walls and a base thus more fully enclosing the drawer.

If the document sorter is intended for use in ordering smaller numbers of items, such as a single month of personal checks, some of the slots, particularly slots 153–156, may be excluded. Furthermore, the remaining slots may all have the same width.

The above are merely exemplary of the possible changes or variations.

Because many varying and different embodiments may be made within the scope of the inventive concept herein taught, and because many modifications may be made in the embodiments herein detailed in accordance with the descriptive requirements of the law, it is to be understood that the details herein are to be interpreted as illustrative and not in a limiting sense.

What is claimed as invention is:

1. A device for facilitating document sorting comprising:

a housing having a frame with a drawer opening and a document accepting portion, said document accepting portion being disposed generally above said frame and being supported by said frame, said document accepting portion including a first series of slots for receving the documents and temporarily retaining the documents therein, said first series of slots including a first slot, a last slot and a plurality of intermediate slots disposed between said first and last slot, said slots of said first series of slots being parallel to one another and arranged successively one behind another, said slots of said first series of slots being horizontally staggered with respect to one another, such staggering of each pair of slots being in the same direction moving from the first slot to the last slot; and a drawer selectively positionable at a first position within said housing and beneath said document accepting portion of said housing and at a second position extending from said housing through said drawer opening, said drawer including a second series of slots for receiving the documents.

2. The device of claim 1 wherein each slot of said first series of slots includes a front wall, a rear wall and an end wall, each said slot being open on the top and on one end, the open ends of all of said slots of said first series of slots opening in a first direction, the end walls of all of said slots of said first series of slots being parallel to one another and horizontally staggered with respect to one another, such staggering of said end walls of each pair of adjacent slots being in the same direction moving from the first slot to the last slot and being substantially equal, said direction of staggering moving from the first slot to the last slot being substantially the same direction in which the open ends of said slots of said first series of slots open.

3. The device of claim 2 wherein said document accepting portion includes a third series of slots disposed adjacent to at least some of the slots of said first series of slots.

4. The device of claim 3 wherein said third series of slots includes a first slot and a last slot, and a plurality of intermediate slots disposed between said first and last slots.

5. The device of claim 4 wherein each slot of said third series of slots are parallel to one another and are arranged successively one behind another.

6. The device of claim 5 wherein each slot of said third series of slots has a front wall, a rear wall and an end wall, the end wall of each slot of said third series of slots juxtaposing the end wall of one of the slots of said first series of slots.

7. The device of claim 6 wherein said first series of slots includes a first set of slots and a second set of slots, each slot of said second set of slots alternating with a slot of said first set of slots, the slots of said second set of slots being wider moving from the front wall to the back than are the slots of said first set of slots.

8. The device of claim 7 wherein said document accepting portion includes a document receptacle disposed in front of said first and third series of slots.

9. The device of claim 1 wherein said second series of slots includes a first slot, a second slot, and a plurality of intermediate slots, the slots of said second series of slots being parallel to one another and arranged successively one behind the other.

10. The device of claim 9 wherein said slots of said second series of slots are substantially parallel to said slots of said first series of slots and are staggered with respect to one another, such staggering of each pair of adjacent slots being in the same direction moving from the first slot to the last slot of said second series of slots as the slots of said first series of slots are staggered.

11. The device of claim 10 wherein each slot of said second series of slots includes a front wall, a rear wall and an end wall, each slot of said second series of slots being open on the top and one end, the en... walls of the slots of said second series of slots being staggered moving from the firt slot to the last slot in the direction in which the open ends of the slots of said second series of slots open.

12. A device for facilitating document sorting comprising:

a housing having a frame with a drawer opening and a document accepting portion, said document accepting portion being disposed generally above said frame and being supported by said frame, said document accepting portion including a first document receptacle for holding documents to be sorted and a second document receptacle for holding sorted documents;

said document accepting portion further including a first series of slots for receiving the documents, said first series of slots being positioned generally behind said first and second document receptacles, said first series of slots including a first slot, a last slot and a plurality of intermediate slots disposed between said first slot and last slot, said slots of said first series of slots being parallel to one another and arranged successively one behind another, said slots of said first series of slots being staggered with respect to one another, such staggering of each pair of adjacent slots being in the same direction moving from the first slot to the last slot and being equal, each slot of said first series of slots including a front wall, a rear wall and an end wall, each slot being open on the top and one end, said document accepting portion also including a third series of slots disposed adjacent to at least some of the slots of said first series of slots, said third series of slots including a first slot and a last slot, and a plurality of intermediate slots disposed between said first and last slots of said third series of slots, each slot of said third series of slots being parallel to one another and arranged successively one behind another, each slot of said third series of slots having a front wall, a rear wall and an end wall, the end wall of each slot of said third series of slots juxtaposing the end wall of one of the slots of said first series of slots; and a drawer selectively positionable at a first position within said housing and beneath said document accepting portion of said housing and at a second position extending from said housing through said drawer opening, said drawer including a second series of slots for receiving the documents.

* * * * *